United States Patent [19]

Saller

[11] 4,406,423

[45] Sep. 27, 1983

[54] REEL SUPPORT SYSTEM

[75] Inventor: Stephen W. Saller, Hamden, Conn.

[73] Assignee: Wire Machinery Corporation of America, New Haven, Conn.

[21] Appl. No.: 144,333

[22] Filed: Apr. 28, 1980

[51] Int. Cl.[3] ..... D07B 7/06

[52] U.S. Cl. ..... 242/129.51; 57/127.5; 91/44; 92/5 L; 92/33; 92/98 D

[58] Field of Search ..... 92/5 R, 5 L, 130 A, 92/33, 98 D; 91/44, 45; 57/127.5; 242/129.6, 129.51, 68.4

[56] References Cited

U.S. PATENT DOCUMENTS

| | | | |
|---|---|---|---|
| 2,893,208 | 7/1959 | Olson | 92/5 R |
| 3,000,359 | 9/1961 | May | 91/45 |
| 3,180,235 | 4/1965 | Schmitz | 92/98 D |
| 3,217,610 | 11/1965 | Roskin | 92/5 R |
| 3,326,089 | 6/1967 | Machado | 92/5 R |
| 3,528,619 | 9/1970 | Durr | 242/25 R |
| 3,844,197 | 10/1974 | Kramer | 91/44 |
| 3,889,576 | 6/1975 | Sheffer | 91/44 |
| 3,911,793 | 10/1975 | Izumi | 92/33 |
| 4,130,985 | 12/1978 | Varga | 242/129.6 |
| 4,316,597 | 2/1982 | Goodman | 92/108 |

FOREIGN PATENT DOCUMENTS

| | | | |
|---|---|---|---|
| 2338405 | 3/1974 | France | 92/5 L |

*Primary Examiner*—Abraham Hershkovitz
*Attorney, Agent, or Firm*—Costas, Montgomery & Dorman

[57] ABSTRACT

A fluid operated pintle assembly for rotatively supporting a reel where clearance is provided between the walls of a pintle carrying piston and its cylinder and an annular diaphragm extends across the piston and cylinder in sealing engagement and extends down into the clearance.

4 Claims, 6 Drawing Figures

REEL SUPPORT SYSTEM

This invention relates to reel carrying systems wherein wire is payed off from a reel and more particularly relates to an improved actuating system for reel supporting pintles.

In a wire stranding system, wire is payed off from a plurality of reels to a stranding station. As the wire on the reel is exhausted, the reel must be replaced with one with a fresh supply of wire. The reels are rotatably supported in cradles which are also rotatably mounted. It is common practice to have the reels rotatably mounted on pintles which are fluid actuated to release the reel, while being spring biased into a reel engaging position.

The present invention provides a new and improved pintle actuating system of the fluid operated type in which the pintles are actuated to disengage a reel upon application of fluid pressure using a mechanism of a piston-cylinder arrangement and where new and improved means are provided in the structure of the piston-cylinder and mounting of the pintle is retracted and does not require close tolerances between the piston and cylinder defining means.

The invention further provides a new, improved, and simplified warning and safety device, which until actuated, will not permit retraction of the piston and the pintle therewith; and, further provides means for always signifying when the pintle is not in a full engaging position with the reel. A pintle actuating device may generally be considered as a spring biased device for engaging a reel and a fluid actuated retract system. In the known systems, the piston is in sliding engagement with the cylinder defining means and conventional seals are provided therebetween to maintain fluid tight integrity.

In the present invention, substantial clearance may be left between the piston and cylinder walls and an annular diaphragm is provided overlying a wall of the piston and the cylinder defining means, and defining a seal therebetween. Then, when fluid pressure is applied to the piston, there need be no sealing engagement or close contact between the piston and cylinder inasmuch as the diaphragm provides a seal and will in essence roll with movement of the piston in the cylinder, in the clearance therebetween. One or more guide pins may be provided for maintaining the axial position of the piston and the cylinder. The piston itself rotatably carries the pintle which engages the reel.

Radially extending through the cylinder defining means is a pin which normally closes a fluid passage to the cylinder, and maintains the piston in a given reel engaging position. Before the piston can be retracted to disengage the reel, the pin must be moved, under the influence of fluid pressure, to uncover a passageway into the piston-cylinder assembly. The pin is arranged so that when it is retracted, an indication is given that the pintle is not in a reel engaging position. Upon reactuation of the pintle to again engage a reel, the safety device will alert the operator whenever the pintle is not in a full reel engaging position. However, when the pintle is in the full engaging position, the warning is extinguished.

An object of this invention is to provide a new and improved pintle assembly for supporting a reel.

The features of the invention which are believed to be novel are particularly pointed out and distinctly claimed in the concluding portion of this specification. The invention, together with further objects and advantages thereof, may best be appreciated by reference to the following detailed description and the drawings wherein:

Figure 1:
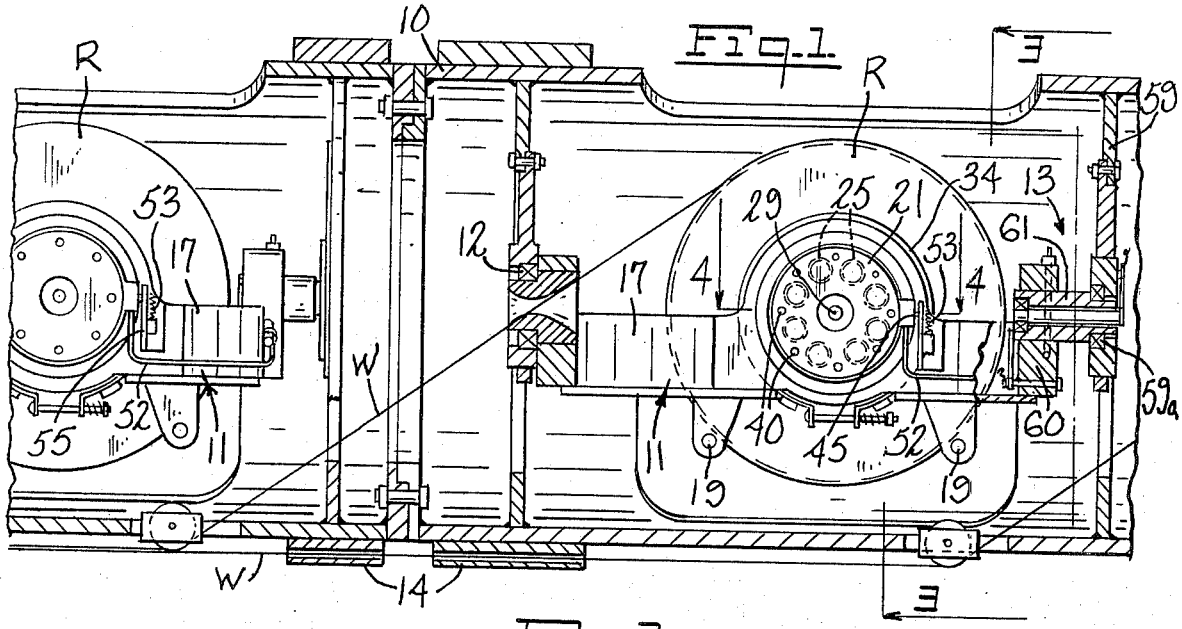
FIG. 1 is a side elevation partly in section of a portion of a wire standing machine.
Figure 2:
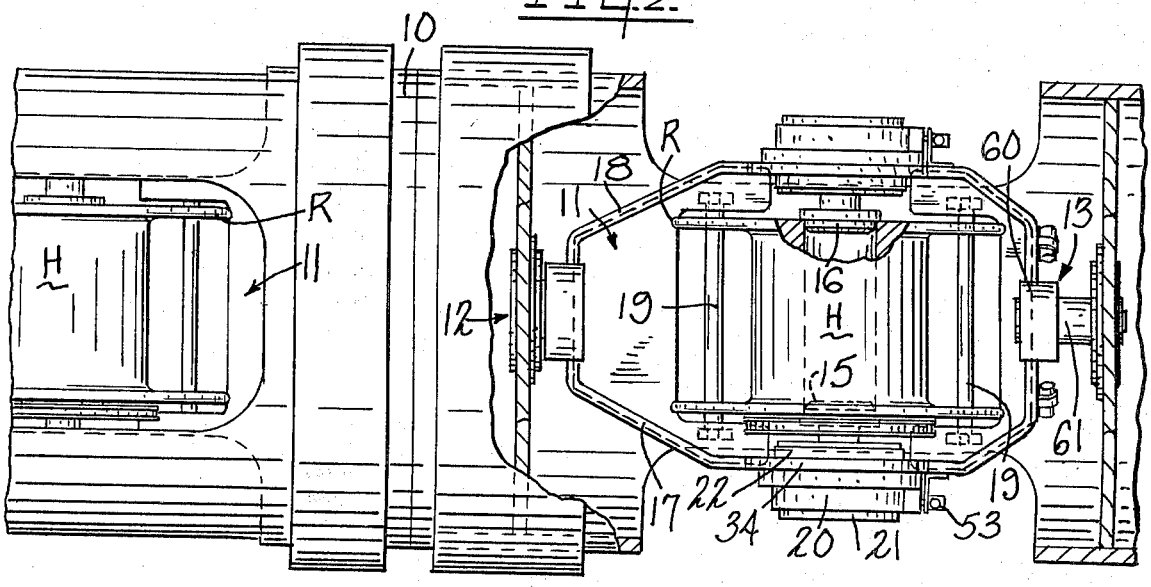
FIG. 2 is a plan view of the device of FIG. 1 with the exterior housing partially cut away.
Figure 4:
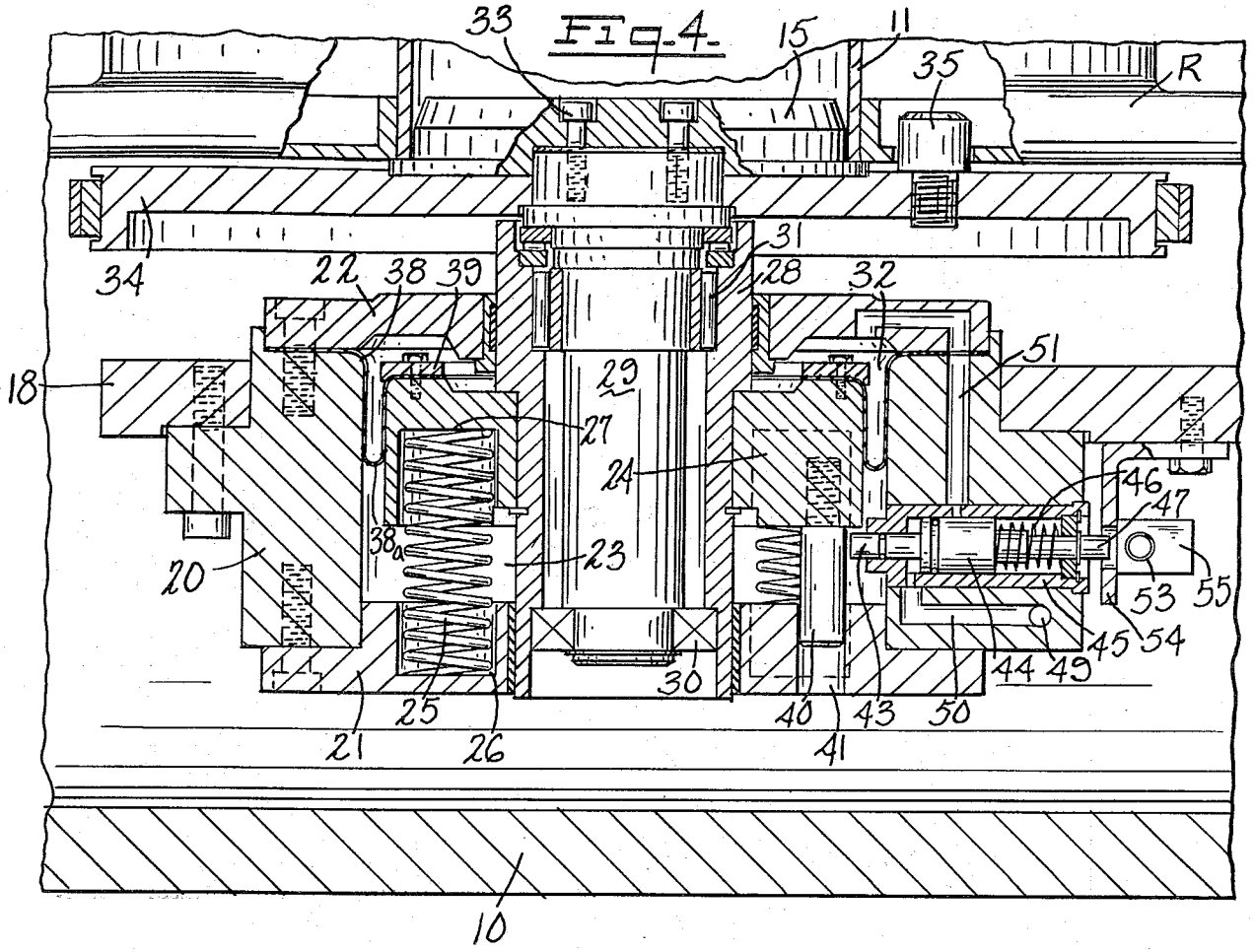
FIG. 4 is a sectional view seen in the plane of lines 4—4 of FIG. 1 showing the pintle-cylinder assembly.

As shown in FIG. 1, the tube 10 of a wire stranding machine pivotally supports a plurality of cradles 11 on bearing assemblies 12 and 13. Each cradle 11 rotatably supports thereon a reel to pay out wire W to a stranding die, not shown, through guides 14. The reels are supported on rotatable pintle assemblies 15 and 16. The pintles are rotatably mounted on the pistons of cylinder assemblies, mounted to spaced apart walls 17 and 18 of cradle 11. Retaining rods 19 extend between walls 17 and 18 beneath a reel. Each of the cylinder assemblies include a body member 20 secured to a cradle wall 17, as shown in FIG. 4. An end wall member 21 and a front wall member 22 together with body member 20 define a cylindrical cavity 23. A piston 24 is received in cavity 23 and is biased towards a reel engaging position by a plurality of springs 25 received in seats 26 in end wall 21 and seats 27 in piston 24. The pintle assemblies 15 and 16 are identical except for the inclusion of brake ring 34.

Extending through piston 24 in a sleeve 28 is a pintle shaft 29 rotatably supported by bearings 30 and 31. The pintle 15 is secured as by means of bolts 33 to the end of shaft 29. A brake ring 34 is carried on the pintle shaft of pintle assembly 16. A drive dog 35 for engagement with a reel is carried on brake ring 34.

As shown, the pintle 13 in its extended position engaging hub H of reel R.

Substantial clearance is provided between the outer surface of piston 24 and the internal surface of cylinder 23. An annular diaphragm 38 is secured between body member 20 and front end cap 22, and also by an annulus 39. The diaphragm 38 extends with a U-fold **38*a* into the clearance between the piston and the cylinder and defines a fluid pressure chamber 32 between piston 24, end cap 22, and body member 20. One or more guide pins 40 extend from piston 24 into passages 41 in end cap 21 and maintain alignment of piston 24** with the cylinder.

When chamber 39 is pressurized with fluid to a sufficient extent, piston 24 will retract from a reel engaging position against the bias of springs 25. Before this can occur a fluid actuated means must be operated to move a pin 43 from a radially extended position in which it blocks the undersurface of piston 24 from retraction. Pin 43 extends from a piston 44 in a cylinder 45. Piston 44 is normally biased by a spring 46 towards a blocking position. The other end of piston 44 includes a contact extension 47 to provide a visual or audible signal when the pintle is not in a reel engaging position, as hereinafter described.

Piston 45 will move pin 43 to the right to an unblocking position when fluid pressure is applied through an inlet 49. A passage 50 from inlet 49 is defined in body member 20 leading to the left end (as shown) of cylinder 45. As the chamber is pressurized, piston 44 will move to the right (as shown) and provide communication from cylinder 45 to a fluid passage 51 leading to chamber 39. Then, only after retraction of pin 43, may the pintle assembly be retracted from a reel engaging position. As the piston 24 is retracted, the diaphragm, as indicated at 38*a*, will in essence roll along the walls of piston 24 and cylinder 23. By providing this cylinder construction, seals such as packing or rings are obviated and the possibility of fluid leakage is substantially eliminated.

Figure 6:
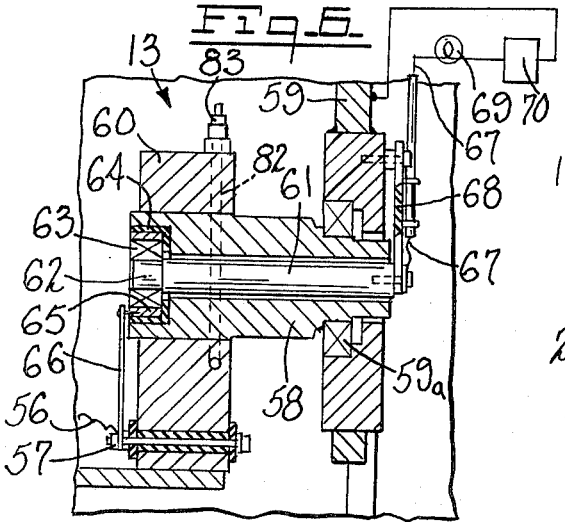
FIG. 6 is an enlarged sectional view of a cradle supporting bearing assembly of FIG. 1.
Figure 3:
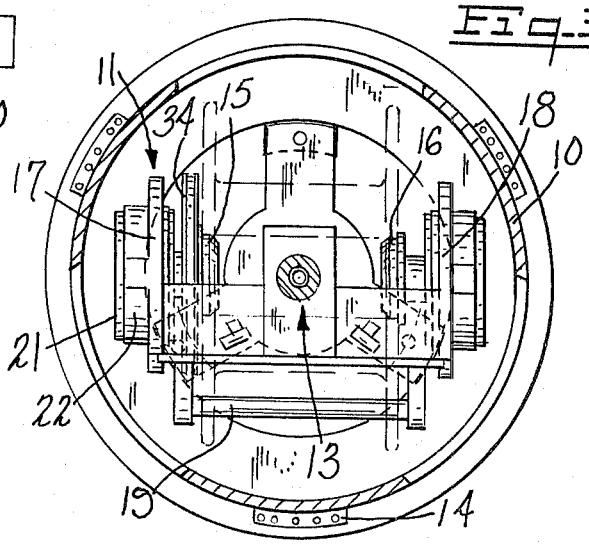
FIG. 3 is a section seen in the plane of lines 3—3 of FIG. 1.
Figure 5:
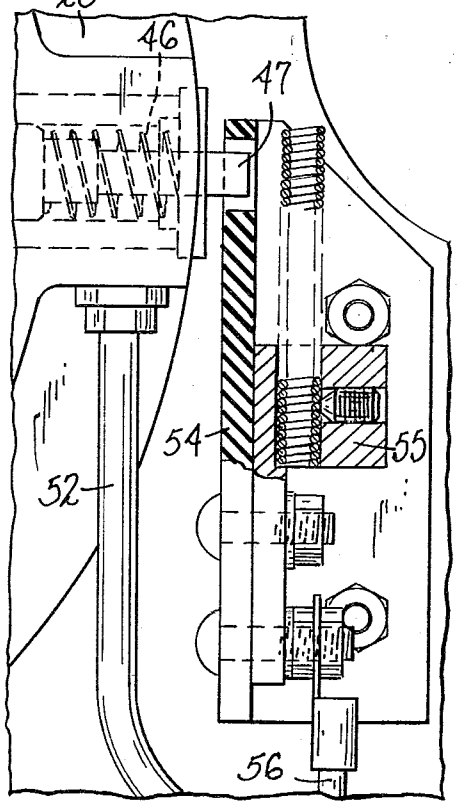
FIG. 5 is an enlarged view, partly in section, of a portion of FIG. 1.

As shown in FIG. 5, a fluid line 52 is coupled to inlet 49 and pin 47 is shown partially extending from housing 20. When piston 44 is moved to a retracted position, pin 47 will make electrical contact with a spring 53. Spring 53 is carried on an insulating bracket 54 on the wall of the cradle, and is electrically connected through a holder and terminal plate 55. A lead 56 extends from plate 55 to a terminal 57 (FIG. 6) on support assembly 13.

Cradle bearing assembly 13 includes a support shaft 58 pivotally mounted in tube wall 59 by a bearing assembly 59*a*. An upright extension 60 of cradle 11 is carried on shaft 58. A spindle 61 extends through a bore in shaft 58, and has an end 62 received in a bearing assembly 63. Bearing assembly 63 and hence spindle 62 is electrically insulated from shaft 58 by a cup-shaped member 64. Terminal 57 is connected to bearing sleeve 65 by a strap 66. A further connection is made from spindle 61 to a lead 67. Spindle 61 is not in contact with shaft 58 and is prevented from rotation by a strap 68.

A warning device exemplified as a lamp 69 is connected between a source of electricity indicated by terminal 70 and lead 67. Thus, when contact 47 engages spring 53, a path to ground from terminal 80 is established through warning device 69. The warning indicator, which most likely would be a lamp, will be mounted in a convenient place generally on the tube adjacent each cradle to inform the operator when the pintles are not in a reel engaging position and therefore the operator will not put a new reel on line if such an indication occurs.

When the fluid from the fluid chamber 37 is purged, the exiting fluid will hold piston 44 in a retracted position with the end of pin 43 riding on the outer wall of piston 24. As the fluid pressure decreases, springs 25 will urge the pintles toward a reel engaging position and pin 43 will ride on the wall of piston 24 until the piston with pintle thereon reach the reel engaging position shown in FIG. 5. At this time, spring 71 retracts piston 44 and contact 47 will leave spring 53. Then the warning indicator will be extinguished.

The operation of the safety indicator and the pintle upon retraction are sequential and the pintle cannot be retracted until piston 44 removes pin 43 from a blocking position. The piston and pintle may move freely with respect to each other when pin 43 is retracted by virtue of the clearance between the walls thereof. This clearance provides a simplified and maintenance free construction.

A fluid passage 82 with connecting nipple 88 (FIG. 6) may be provided in cradle 18 to supply fluid pressure to both of the cylinders.

While preferred embodiments of the invention have been described, alternate embodiments, as well as other embodiments of the invention may occur to those skilled in the art. Accordingly, the appended claims are intended to encompass all modifications and embodiments of the invention which do not depart from the spirit and scope of the invention.

What I claim is:

1. A system for rotatably supporting a reel on spaced apart pintles including a cradle having spaced apart walls, means defining a cylinder attached to at least one of said walls, said cylinder having an internal wall, a piston having a head in said cylinder and having clearance with said internal wall, an annular diaphragm overlying said piston head and said cylinder defining means and providing a seal over the clearance therebetween said diaphragm folding into the clearance between said piston and said cylinder wall, said piston having walls defining a control bore and a peripheral wall, a pintle rotatably carried in said piston bore, a plurality of springs disposed between the walls defining said bore and said peripheral wall and biasing said piston toward an extended position to cause said pintle to engage a reel, a fluid passage defined in said cylinder defining means to the head of said piston, fluid operated means mounted in said cylinder defining means and extending radially inwardly of the defined cylinder to a position to block said piston from retraction, said fluid operated means blocking said fluid passage in an extended position but being responsive to application of fluid pressure to said fluid passage to retract and permit fluid pressure to be applied to said piston head.

2. The system of claim 1 where said fluid operated means comprises a piston-cylinder assembly in said fluid passage, the piston of said assembly blocking said fluid passage until retracted by fluid pressure, whereby said pintle carrying piston cannot be retracted until the piston of said piston-cylinder assembly is retracted.

3. The system of claim 5 further including means responsive to retraction of the piston of said piston-cylinder assembly for indicating said pintle carrying piston is retracted.

4. The system of claim 2 whereby a pin extends from one end of the piston of said piston-cylinder assembly to said blocking position and a second pin-like member extends from the other end of said piston of said piston-cylinder assembly adapted to complete an electrical circuit for indicating said pintle carrying piston is retracted.

* * * * *

UNITED STATES PATENT AND TRADEMARK OFFICE

CERTIFICATE OF CORRECTION

PATENT NO. : 4,406,423

DATED : September 27, 1983

INVENTOR(S) : Stephen W. Saller

It is certified that error appears in the above-identified patent and that said Letters Patent are hereby corrected as shown below:

IN THE COVER PAGE

Amend [75] to read: -- Stephen W. Saller and Donald Arpine, both of Hamden, Conn. --.

Col. 2, line 42: Delete "the pintle 13 in its" and substitute therefor -- pintle assemblies 15 and 16 are in --.

line 54: After "chamber", change "39" to -- 32 --.

line 66: After "Piston", change "45" to --44 --.

Col. 3, line 5: After "ber", change "39" to -- 32 --.

line 44: After "chamber", change "37" to -- 32 --.

line 51: Delete "FIG. 5" and substitute therefor -- FIG. 4 --.

line 51: After "spring", change "71" to -- 46 --.

Col. 4, line 5: After "nipple", change "88" to -- 83 --.

line 6: After "cradle", change "18" to -- 11 --.

UNITED STATES PATENT AND TRADEMARK OFFICE

CERTIFICATE OF CORRECTION

PATENT NO. : 4,406,423

DATED : September 27, 1983

INVENTOR(S) : Stephen W. Saller

It is certified that error appears in the above-identified patent and that said Letters Patent are hereby corrected as shown below:

Col. 4, line 26: Change "control" to -- central --.

line 46: After "claim", change "5" to --2--.

Signed and Sealed this

*Twenty-seventh* Day of *November 1984*

[SEAL]

*Attest:*

GERALD J. MOSSINGHOFF

*Attesting Officer* *Commissioner of Patents and Trademarks*